United States Patent [19]

Dickinson

[11] Patent Number: 5,069,342

[45] Date of Patent: Dec. 3, 1991

[54] COMBINATION TOOL BOX/ORGANIZER

[75] Inventor: Thomas Dickinson, St. Louis, Mo.

[73] Assignee: Contico International, Inc., St. Louis, Mo.

[21] Appl. No.: 566,174

[22] Filed: Aug. 13, 1990

[51] Int. Cl.[5] ..... B65D 85/00

[52] U.S. Cl. ..... 206/372; 211/7; 312/216; 312/DIG. 33

[58] Field of Search ..... 206/231, 234, 338, 372–379; 211/4, 7, 70.6; 220/523, 524, 526, 528; 312/107.5, 109, 216, DIG. 33

[56] References Cited

U.S. PATENT DOCUMENTS

| | | | |
|---|---|---|---|
| 903,668 | 11/1908 | Carl | 206/373 |
| 1,984,345 | 12/1934 | Kenedy | 206/373 |
| 2,286,427 | 6/1942 | Levensten | 312/DIG. 33 |
| 2,739,863 | 3/1956 | Ferris | 312/DIG. 33 |
| 2,823,971 | 2/1958 | Hoyt | 312/DIG. 33 |
| 4,195,889 | 4/1980 | Coyne | 312/DIG. 33 |
| 4,266,835 | 5/1981 | Schmidt | 312/DIG. 33 |
| 4,616,890 | 10/1986 | Romick | 312/216 |
| 4,659,154 | 4/1987 | Jenkins | 312/DIG. 33 |
| 4,733,703 | 3/1988 | Cimino | 206/373 |

FOREIGN PATENT DOCUMENTS

| | | | |
|---|---|---|---|
| 0659110 | 3/1963 | Canada | 312/216 |
| 0995474 | 12/1951 | France | 312/DIG. 33 |
| 1036813 | 9/1953 | France | 312/DIG. 33 |
| 0431080 | 7/1935 | United Kingdom | 312/216 |

OTHER PUBLICATIONS

"TUFF Parts Organizer", advertisement by Contico International Inc.

*Primary Examiner*—Jimmy G. Foster

*Attorney, Agent, or Firm*—Rogers, Howell & Haferkamp

[57] ABSTRACT

A container which is a combination tool box/organizer. The organizer section comprises at least two shelves with at least two bins per shelf. The shelves have protector covers which can be locked when in a closed position.

6 Claims, 4 Drawing Sheets

COMBINATION TOOL BOX/ORGANIZER

BACKGROUND OF THE INVENTION

I. Field of the Invention

The invention is directed to portable containers for transporting tools and materials. In particular, the invention focuses on organizer closures.

II. Description of the Prior Art

Tool boxes and organizers are well known. Tradesmen have traditionally utilized tool boxes to carry their tools to the job site. Organizers comprised of a set of storage bins are also well known for storing and organizing loose materials such as nuts and bolts.

It is highly advantageous to have a single unit which serves both as a tool box and organizer. This allows the tradesmen to always have both his tools and materials available. However, it is a significant problem to keep the storage bins in a locked position during transport.

The locking mechanism on an organizer must be easy to use and yet effective. It must allow unrestricted access with strong security. Most importantly it cannot affect the function of either the tool box or organizer. However, organizers do not contain such locks since they are not usually transported over long distances.

It is an object of the present invention to provide a combination tool box/organizer. In particular, it is an object of the present invention to provide a combination tool box/organizer wherein the organizer comprises sets of storage bins which can be locked into a closed position during transport. It is a further object of the invention to provide a locking system for the front cover of an organizer regardless whether it is combined with a tool box.

SUMMARY OF THE INVENTION

The invention is directed to a combination tool box/organizer wherein the organizer section comprises at least two horizontal shelves having at least two removable storage bins on each shelf. Each of the shelves has a rotatable front cover with locking pins on its ends. When the cover is closed the locking pins engage corresponding slots in the organizer body. A locking mechanism closes the slots to preclude the opening of the cover.

DESCRIPTION OF THE PREFERRED EMBODIMENTS

Figure 2:
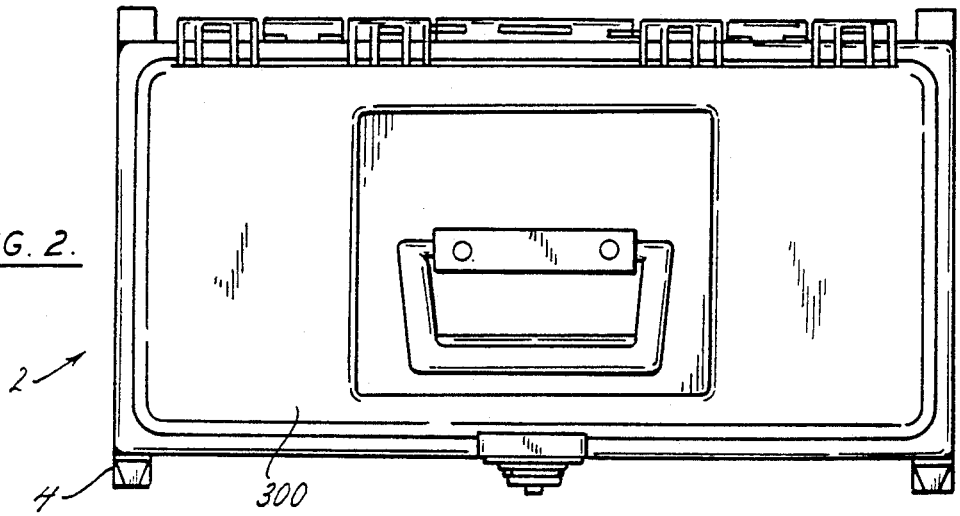
FIG. 2 is a top view of a tool box/organizer of the invention.
Figure 1:
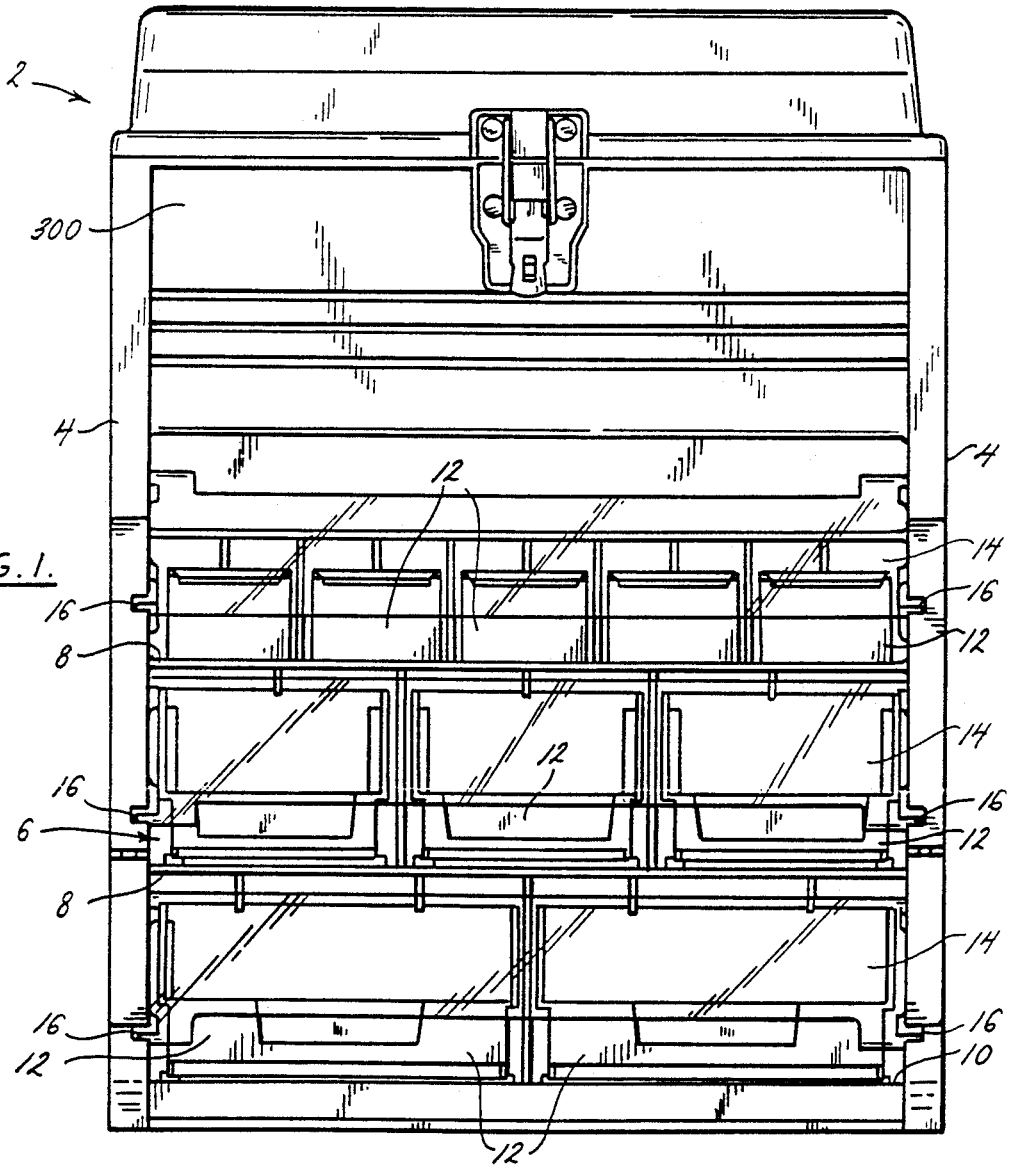
FIG. 1 is a front view of a combination tool box/organizer of the invention.
Figure 3:
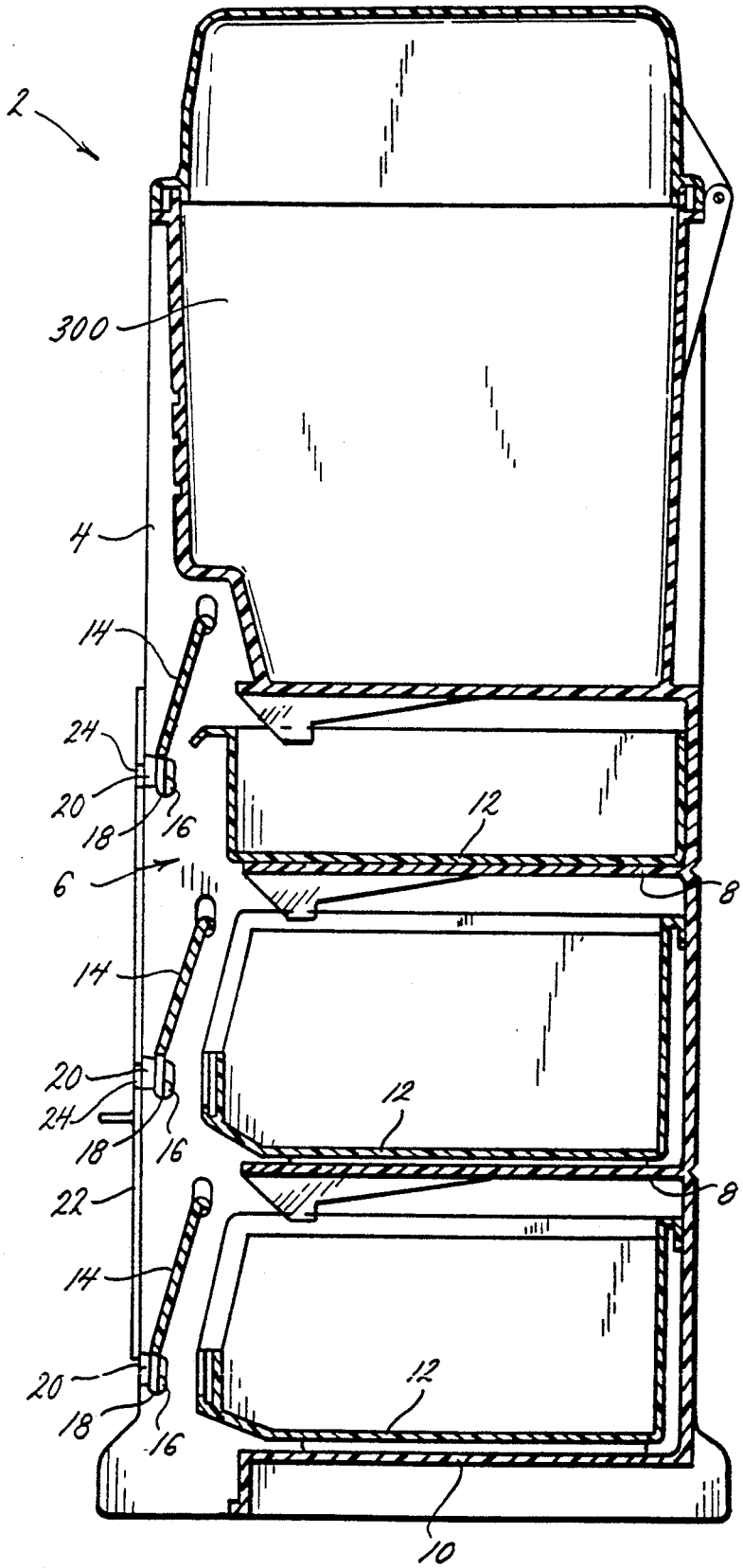
FIG. 3 is a side view, in section of the tool box/organizer of the invention.
Figure 4:
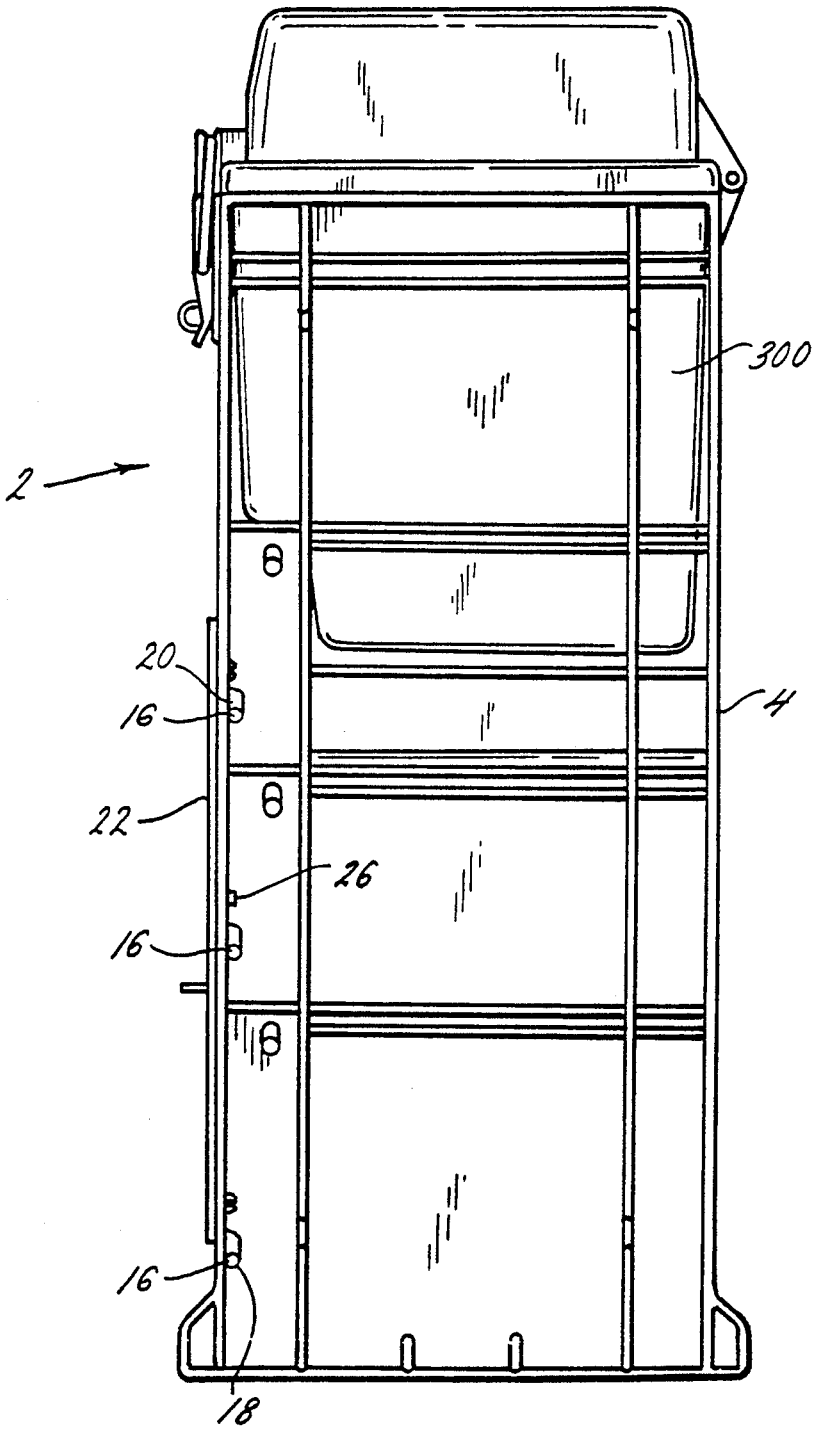
FIG. 4 is a side view of the tool box/organizer of the invention with cover closed.

As shown in FIG. 1 a combination tool box/organizer 2 comprises an organizer frame 4 with an opening 6. The opening 6 has at least one shelf 8 which divides the opening into two sections with the base of the frame 4 forming a shelf 10. Each shelf 8 and 10 has at least two storage bins 12.

The storage bins 12 are covered with a clear plastic cover 14. The covers 14 span the width of the opening 6 and preferably have a height less than the height of the shelves 8 and 10. As shown in FIGS. 2 through 7, the covers 14 have locking pins 16 which protrude from the sides of the cover. These pins 16 fit within the slots 18 of the frame when the cover 14 is in the down or closed position.

The slots 18 have an opening 20 for receiving the pins 16. Following insertion of the pins 16 into the opening 20 they fall below the opening 20 into the slot 18 by translatory movement of the cover 14. In the present invention a locking mechanism 22 slides over the opening 20 to prevent the pin 16 from popping out of slot 18 during movement of the organizer.

At the top of the frame 4 of the organizer is mated a tool box 300. The tool box 300 section is shaped as a conventional tool box for carrying hard tools. The organizer section 4 contains bins designed for screws, bolts, etc. Normally, being able to lock down the covers 14 on an organizer is not critical since organizers normally remain at a work bench, in a truck, or in a shop.

However, when the organizer is mated with a tool box it becomes more mobile. The combination is designed to be carried to a work site. If the covers open and the bins spill out a substantial clean up would be required.

The lock mechanism 22 is a plastic bar which extends a substantial length of the organizer. The lock 22 is mounted on a track and has holes 24 corresponding to the openings 20. These holes 24 allow passage of the pins 16 into the openings 20 and slots 18.

Figure 7:
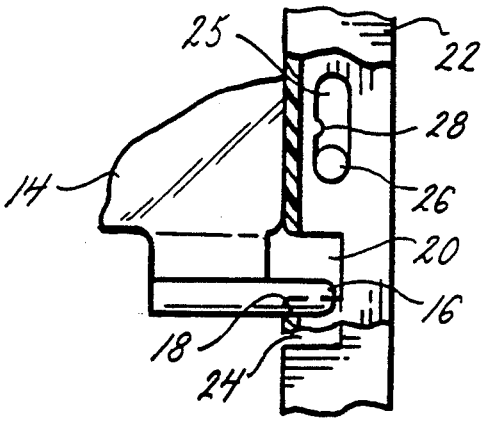
FIG. 7 is section AA of FIG. 7.
Figure 6:
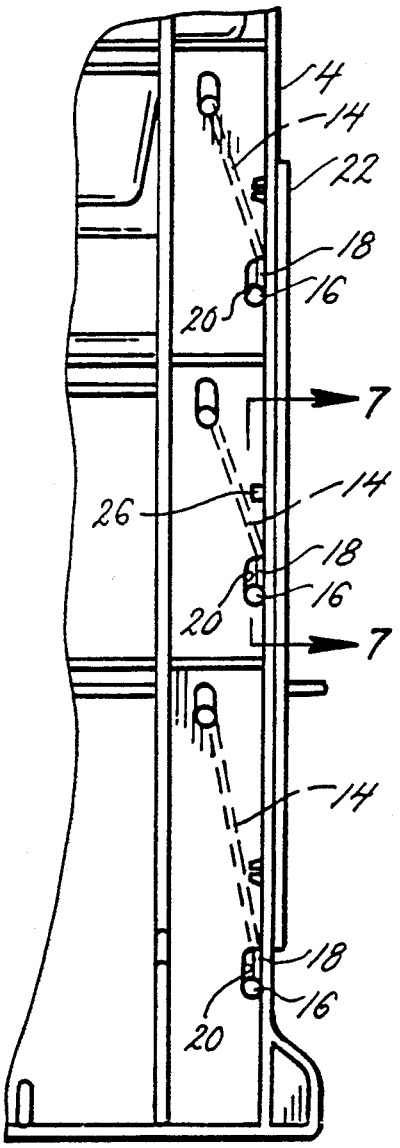
FIG. 6 is an enlarged partial rear view of FIG. 5.
Figure 5:
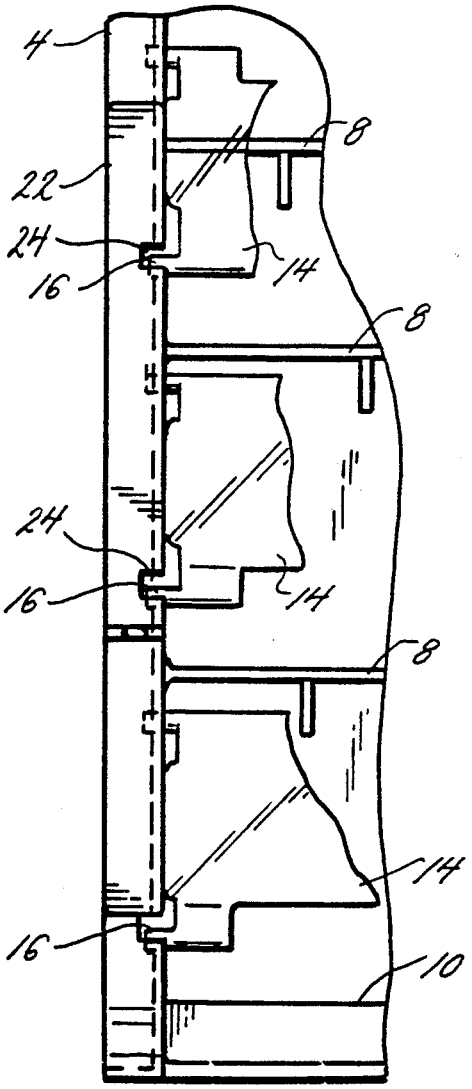
FIG. 5 is an enlarged partial front view of FIG. 4.

To lock the pins 16 the bar 22 is moved downward to cover the openings 20. As shown in FIGS. 6 and 7 a slot 25 is formed in the frame behind the bar 22 and a pin 26 formed on the back side of the bar engages in the slot 25. A protrusion 28 is formed on the frame extending into the slot 25. When the pin 26 moves past protrusion 28 it locks the bar in place. The bar 22 can be moved by application of sufficient force to overcome the fit between pin 26 and protrusion 28.

I claim:

1. A combination tool box/organizer comprising:

a frame, the frame having slots formed therein with openings in the frame providing access to the slots;

a tool box section supported on the frame;

an organizer section supported on the frame, the organizer section including at least two shelves supported by the frame and at least two bins supported on each shelf for sliding movement forward and backward on each shelf, and including front covers supported on the frame in positions in front of the bins, the front covers having pins that pass through the openings in the frame and engage in the slots; and, a lock mechanism bar supported on the frame for movement relative to the slot openings, the bar being movable to cover the openings to lock the front cover pins in the slots and thereby lock the front covers in position in front of the bins.

2. The combination tool box/organizer of claim 1, wherein:

the lock mechanism bar is supported for movement on the frame between first and second positions of the bar relative to the frame, and the frame is provided with at least one protrusion that engages with the bar to retain the bar in the first and second positions.

3. The combination tool box/organizer of claim 2, wherein:

the frame has a second slot formed thereon and the protrusion of the frame extends into the second slot, the lock mechanism bar has a pin formed thereon that projects into the second slot, and the pin slides through the slot to positions on opposite sides of the protrusion as the lock mechanism bar is moved between the first and second positions of the bar relative to the frame.

4. The combination tool box/organizer of claim 1, wherein:

the slots formed in the frame extend in a downward direction relative to the slot openings, and the front cover pins when engaged in the slots move downward in the slots to positions where the front cover pins are retained in the slots.

5. The combination tool box/organizer of claim 4, wherein:

the front cover pins are moved upward in the slots to disengage the pins from the slots.

6. A combination tool box/organizer comprising:

a frame, the frame having slots formed therein with openings in the frame providing access to the slots, the slots extending in a general downward direction relative to the frame;

a tool box section supported on the frame;

an organizer section supported on the frame, the organizer section including at least one shelf supported by the frame and at least one bin supported on the shelf for sliding movement forward and backward on the shelf, and including a front cover supported on the frame for both pivoting movement of the front cover relative to the frame and for translatory movement of the front cover relative to the frame, the front cover having at least one pin that passes through one of the slot openings and engages in one of the slots in response to pivoting movement of the front cover relative to the frame, and the front cover fin moves downward relative to the slot to a position where the pin is retained in the slot in response to translatory movement of the front cover relative to the frame;

a lock mechanism bar supported on the frame for movement relative to the slot opening, the bar being movable to cover the slot opening to lock the front cover pin in the slot and thereby lock the front cover in a position in front of the bin.

* * * * *